US011541513B2

(12) United States Patent
Tsai

(10) Patent No.: US 11,541,513 B2
(45) Date of Patent: Jan. 3, 2023

(54) PLUMBING PLIERS

(71) Applicant: Mytools Enterprise Co., Ltd., Taiping (TW)

(72) Inventor: Cheng-Chang Tsai, Taiping (TW)

(73) Assignee: Mytools Enterprise Co., Ltd., Taiping (TW)

( * ) Notice: Subject to any disclaimer, the term of this patent is extended or adjusted under 35 U.S.C. 154(b) by 205 days.

(21) Appl. No.: 16/951,100

(22) Filed: Nov. 18, 2020

(65) Prior Publication Data

US 2022/0152786 A1 May 19, 2022

(51) Int. Cl.
*B25B 7/12* (2006.01)
*B25B 7/02* (2006.01)
*B25B 7/10* (2006.01)

(52) U.S. Cl.
CPC ..... *B25B 7/12* (2013.01); *B25B 7/02* (2013.01); *B25B 7/10* (2013.01)

(58) Field of Classification Search
CPC .... B25B 7/02; B25B 7/04; B25B 7/10; B25B 7/12; B25B 7/14; B25B 7/16; B25B 7/18; B25B 13/00; B25B 13/10; B25B 13/12; B25B 13/28; B25B 13/34; B25B 13/05
See application file for complete search history.

(56) References Cited

U.S. PATENT DOCUMENTS 3,534,641 A * 10/1970 Le Duc ..... B25B 7/10 81/357
7,255,027 B1 * 8/2007 Tsai ..... B25B 7/10 81/357
2004/0221694 A1 * 11/2004 Kuo ..... B25B 7/10 81/413
2008/0236345 A1 * 10/2008 Bocquet ..... B25B 7/10 81/411

FOREIGN PATENT DOCUMENTS

DE 958459 * 2/1957

* cited by examiner

*Primary Examiner* — Robert J Scruggs
(74) *Attorney, Agent, or Firm* — Alan D. Kamrath; Karin L. Williams; Mayer & Williams PC

(57) ABSTRACT

A pair of plumbing pliers includes two levers, a pawl and a torque spring. After adjusting the desired bite size according to a diameter of a pipe, the levers are pivoted relative to each other in a first range to clamp and release the pipe repeatedly to rotate the pipe. To adjust a bite size of the pair of plumbing pliers according to a diameter of another pipe, the levers are pivoted and then moved relative to each other in a second range. Little resistance is encountered in the first range. However, considerable resistance is encountered in the second range. Hence, the difference between the first and second ranges can easily be felt. Accordingly, it is not likely that a user will, by mistake, enter the second range, i.e., increase the bite size of the pair of plumbing pliers.

1 Claim, 13 Drawing Sheets

PRIOR ART

PRIOR ART

PRIOR ART

PRIOR ART

PLUMBING PLIERS

BACKGROUND OF INVENTION

1. Field of Invention

The present invention relates to a hand tool and, more particularly, to a pair of plumbing pliers.

2. Related Prior Art

Referring to FIGS. 1 through 4, a conventional pair of plumbing pliers includes two levers 1 and 2, a C-shaped spring 5, a pawl 6 and a pivot 8. Each of the levers 1 and 2 includes a shank between a jaw and a handle. The lever 1 further includes a slot 4 in the shank and ratchet teeth 3 formed along an edge of the slot 4. The lever 2 further includes an annular groove 10 extending in a side and an arched slot 9 extending along a section of the annular groove 10. The C-shaped spring 5 is inserted in the annular groove 10. Two bent ends of the C-shaped spring 5 are inserted in the arched slot 9 so that the bent ends of the C-shaped spring 5 are normally in contact with two closed ends of the arched slot 9. One of the bent ends of the C-shaped spring 5 is further inserted in a bore made in the pawl 6 that is inserted in the slot 4. The pivot 8 is inserted in the shanks of the levers 1 and 2 and the pawl 6 so that the levers 1 and 2 and the pawl 6 are pivotally connected to one another. Thus, the pawl 6 is rotated relative to the lever 1 as the lever 2 is pivoted relative to the lever 1.

A "bite size" is the distance between the jaws of the levers 1 and 2 when the handles of the levers 1 and 2 are located as close to each other as possible. The bite size is expected to be marginally smaller than a diameter of a pipe so that the pair of plumbing pliers can tightly bite (or "clamp") the pipe. The bite size of the pair of plumbing pliers is adjusted in compliance with various diameters of pipes.

Referring to FIG. 4, the lever 2 is moved upward or downward relative to the lever 1 to reduce or increase the bite size of the pair of plumbing pliers. To this end, the lever 2 is pivoted away from the lever 1 to rotate the C-shaped spring 5 that in turn disengages the pawl 6 from the ratchet teeth 3. Thus, the lever 2 is allowed to move relative to the lever 1 until the pawl 6 reaches a lower closed end of the slot 4 where the bite size of the pair of plumbing pliers reaches a maximum.

Referring to FIG. 3, when the bite size of the pair of plumbing pliers reaches a desired value, the lever 2 is pivoted toward the lever 1 to allow the C-spring 5 to engage the pawl 6 with the ratchet teeth 3. Thus, the bite size of the pair of plumbing pliers is supposed to remain at the desired value.

A problem is however encountered in the use of the pair of plumbing pliers. When the pair of plumbing pliers is opened to receive a pipe, or when the pair of plumbing pliers is opened to release the pipe before the pair of plumbing pliers is closed to clamp the pipe again, there is a risk that the lever 2 could be excessively pivoted away from the lever 1 so that the lever 2 rotates the C-shaped spring 5 that in turns disengages the pawl 6 from the ratchet teeth 3. Accidentally, the lever 2 is allowed to move relative to the lever 1 and change the bite size of the pair of plumbing pliers.

The present invention is therefore intended to obviate or at least alleviate the problems encountered in the prior art.

SUMMARY OF INVENTION

It is the primary objective of the present invention to provide a reliable pair of plumbing pliers.

To achieve the foregoing objective, the pair of plumbing pliers includes two levers and a pawl. Each of the levers includes a jaw, a handle, a shank formed between the jaw and the handle. The first lever includes a rectilinear slot in the shank thereof and ratchet teeth along an edge of the rectilinear slot. The second lever includes an arched slot in the shank thereof. The shanks of the first and second levers are pivotally connected to each other. The pawl is inserted in the rectilinear slot and pivotally connected to the shank of the second lever and comprises ratchet teeth for engagement with the ratchet teeth of the first lever. The pawl includes a recess and a boss movably inserted in the arched slot. The torque spring includes a first terminal section inserted in the recess and a second terminal section abutted against another edge of the rectilinear slot so that the torque spring brings the ratchet teeth of the pawl into engagement with the ratchet teeth of the first lever. In a first range of pivoting the handle of the second lever relative to the handle of the first lever, a closed end of the arched slot is not in contact with the boss to keep the ratchet teeth of the pawl engaged with the ratchet teeth of the first lever to prevent downward movement of the shank of the second lever relative to the shank of the first lever. In a second range of pivoting the handle of the second lever relative to the handle of the first lever, the closed end of the arched slot is in contact with the boss to disengage the ratchet teeth of the pawl from the ratchet teeth of the first lever to allow downward movement of the shank of the second lever relative to the shank of the first lever.

Other objectives, advantages and features of the present invention will be apparent from the following description referring to the attached drawings.

BRIEF DESCRIPTION OF DRAWINGS

The present invention will be described via detailed illustration of the preferred embodiment referring to the drawings wherein.

DETAILED DESCRIPTION OF PREFERRED EMBODIMENT

Figure 1:
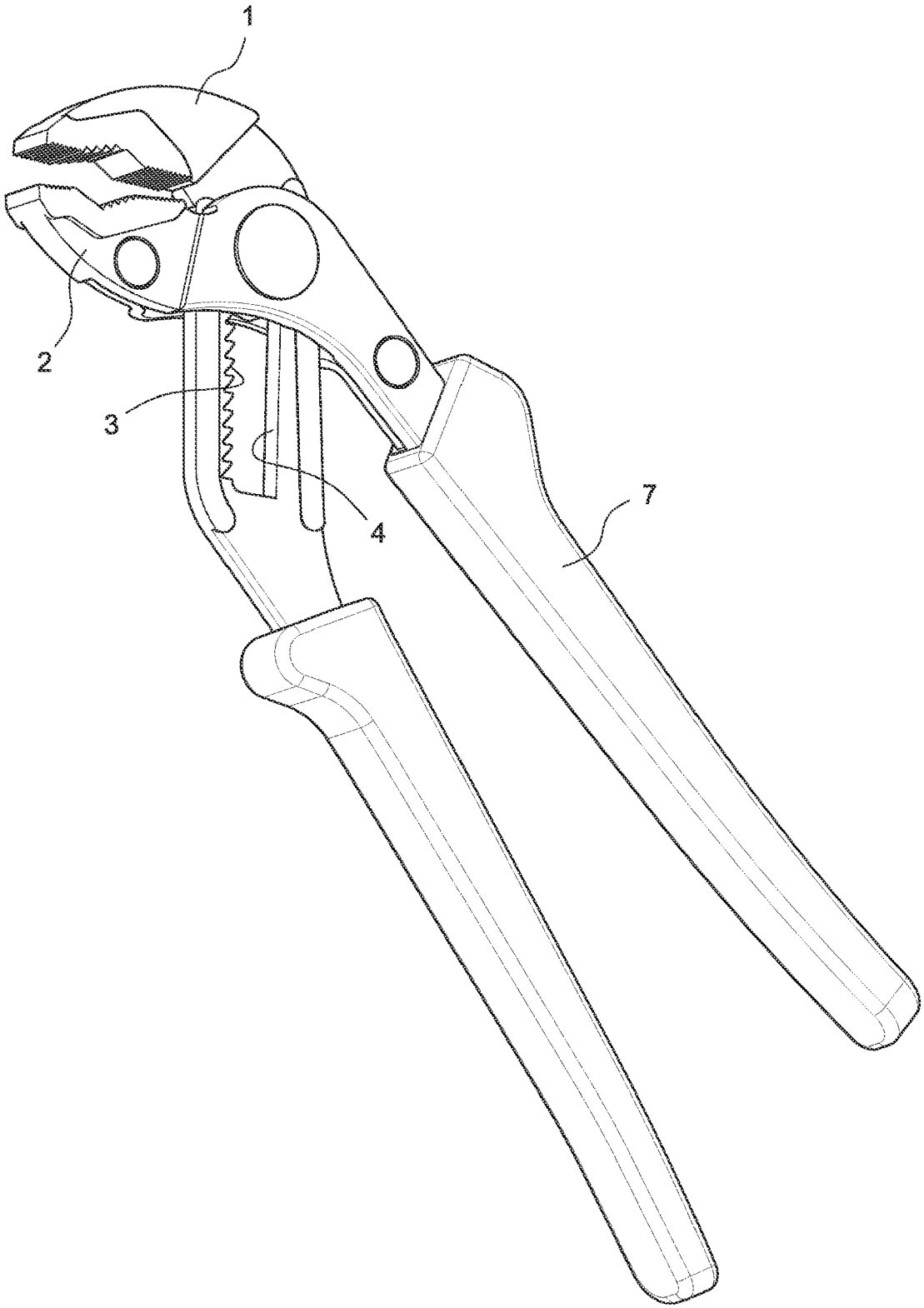
FIG. 1 is a perspective view of a conventional pair of plumbing pliers.
Figure 2:
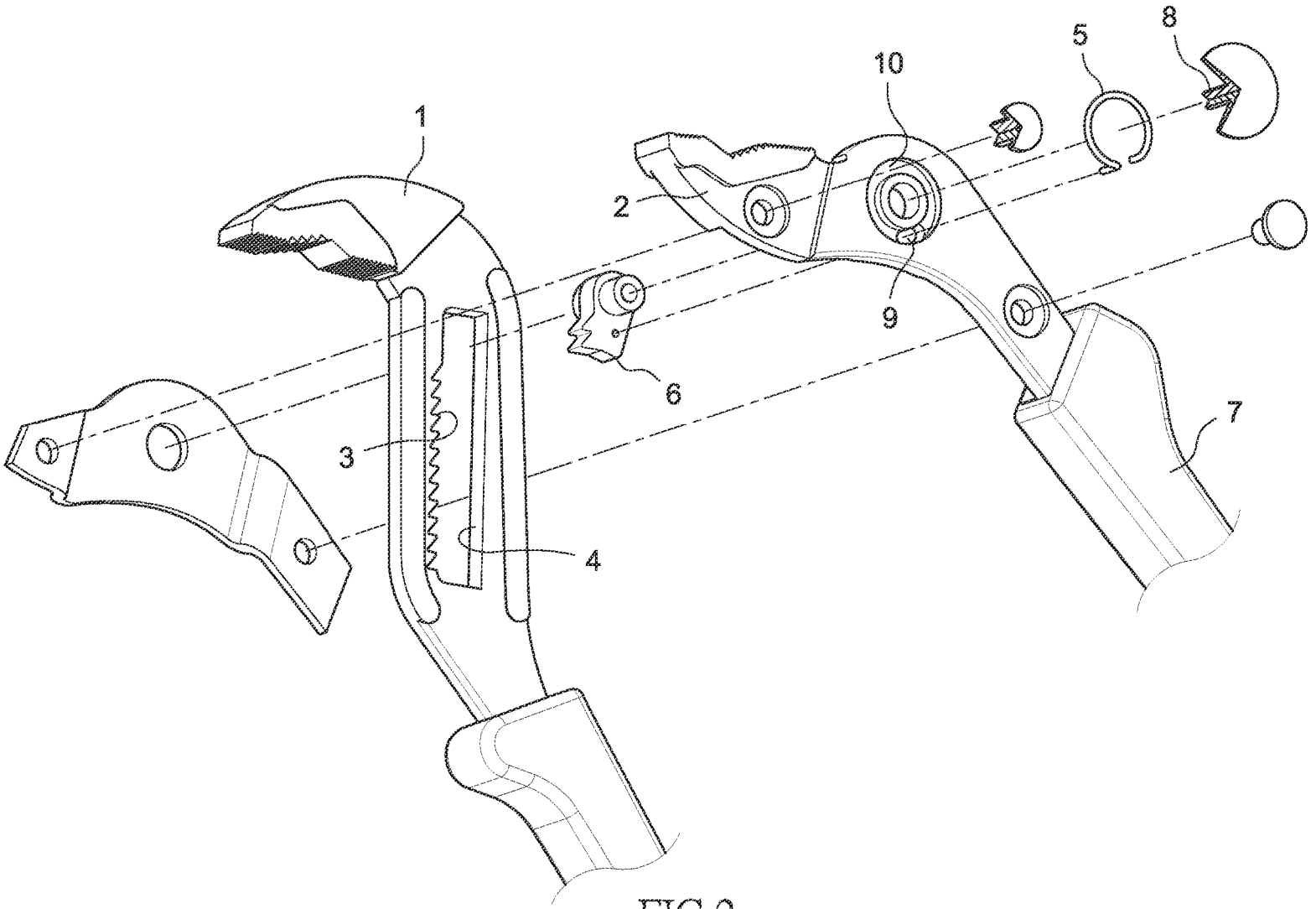
FIG. 2 is an exploded view of the pair of plumbing pliers depicted in FIG. 1.
Figure 3:
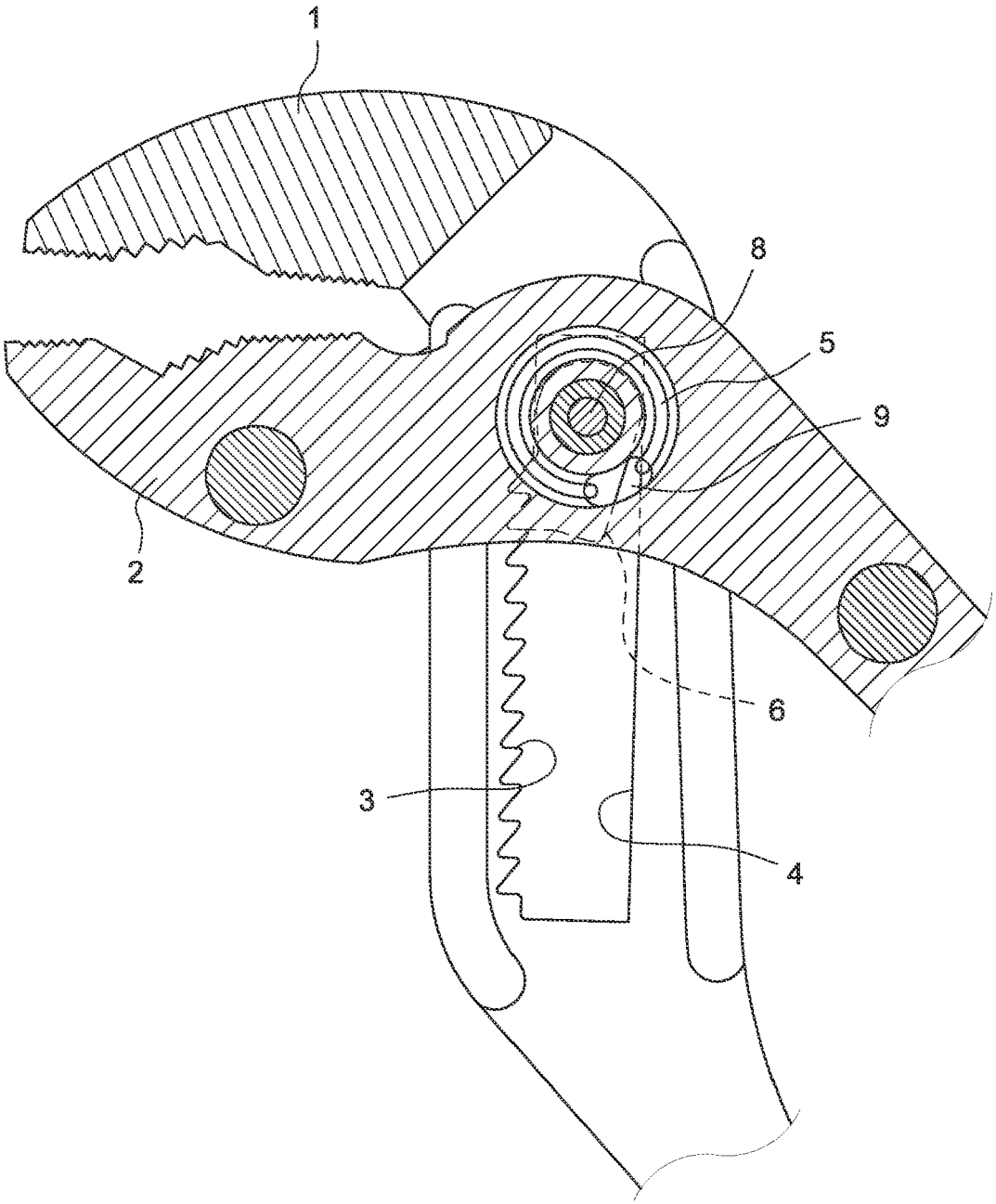
FIG. 3 is a cross-sectional view of the pair of plumbing pliers shown in FIG. 1.
Figure 4:
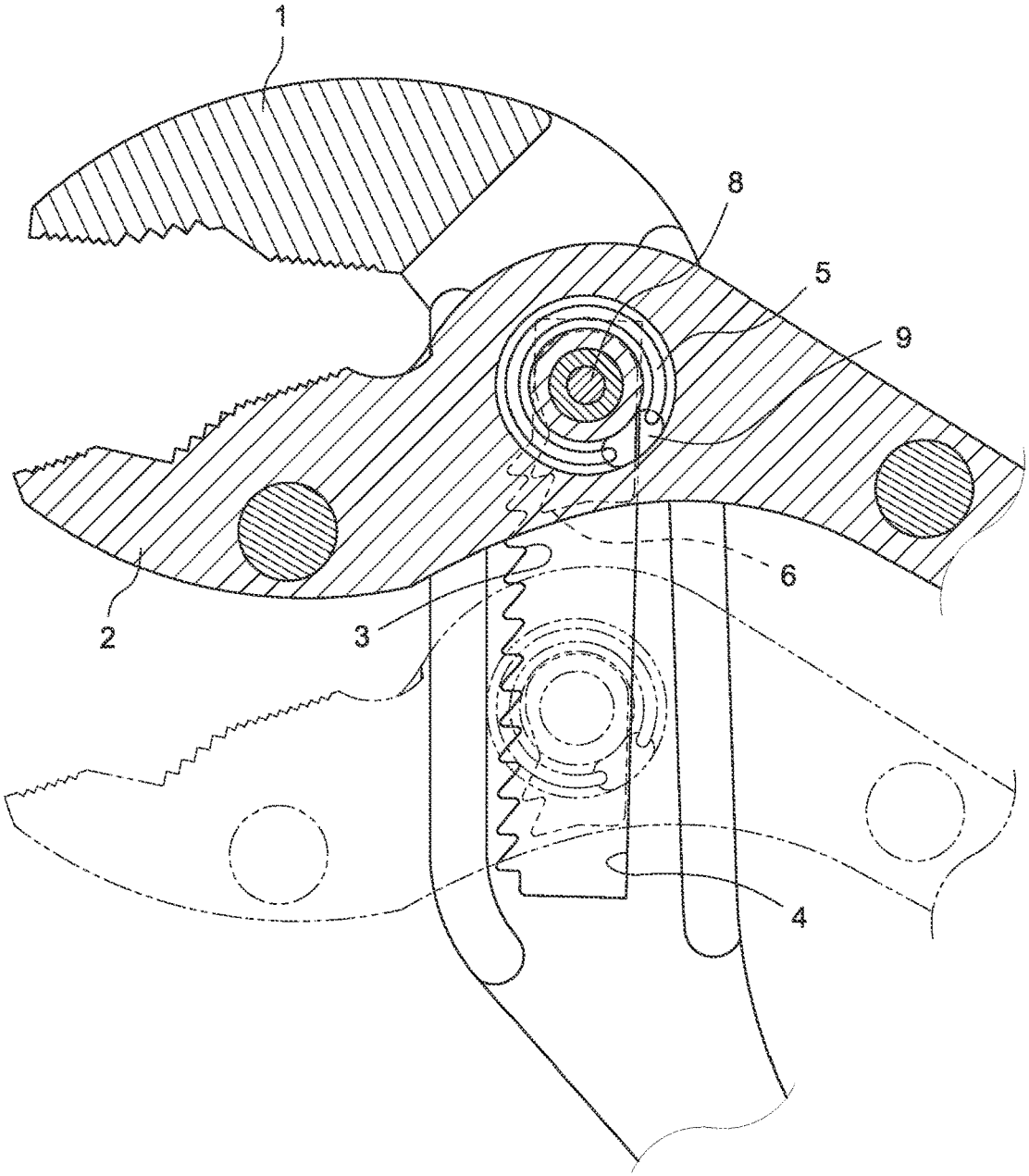
FIG. 4 is a cross-sectional view of the pair of plumbing pliers in another position than shown in FIG. 3.
Figure 5:
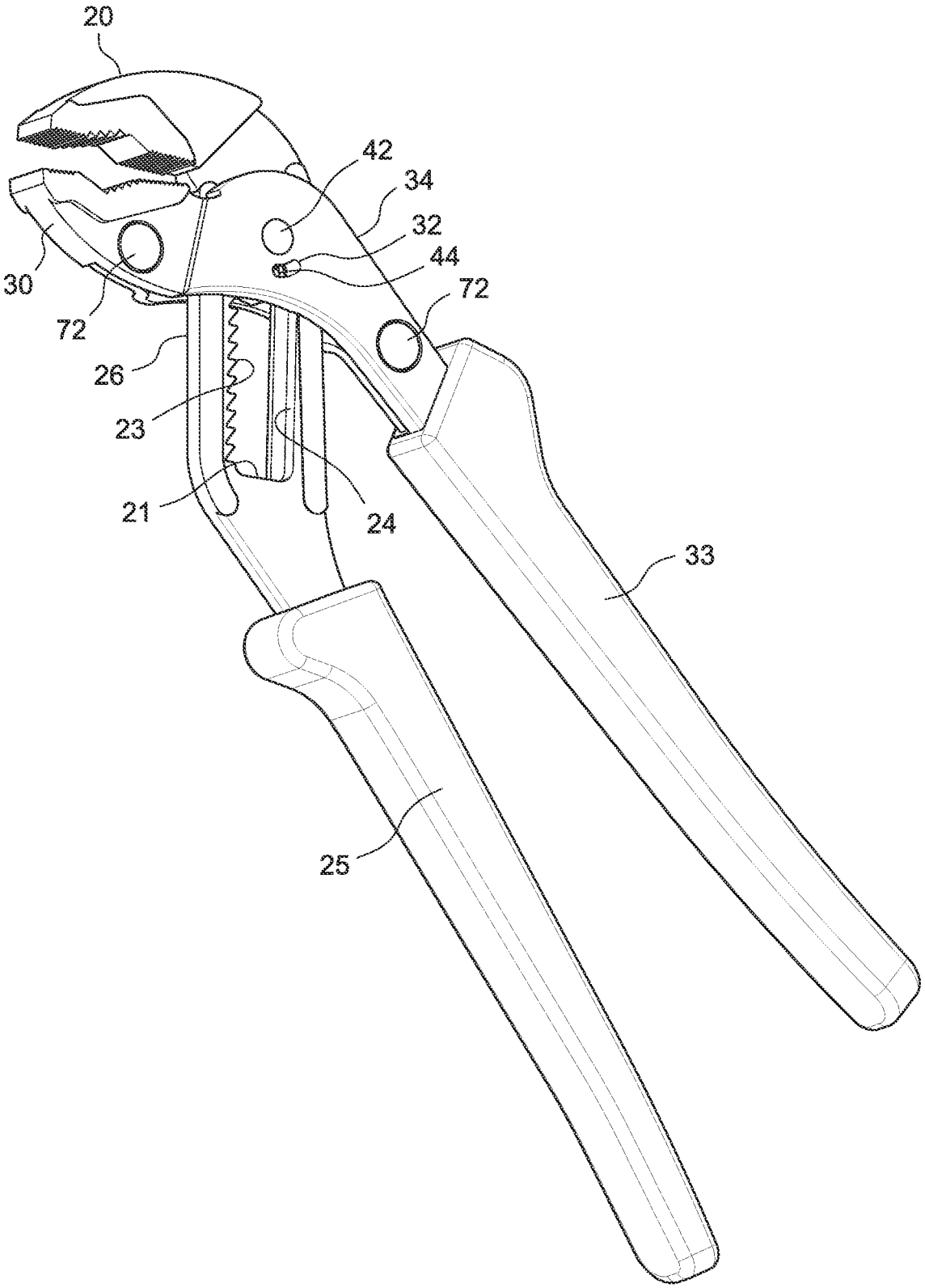
FIG. 5 is a perspective view of a pair of plumbing pliers according to the preferred embodiment of the present invention.
Figure 6:
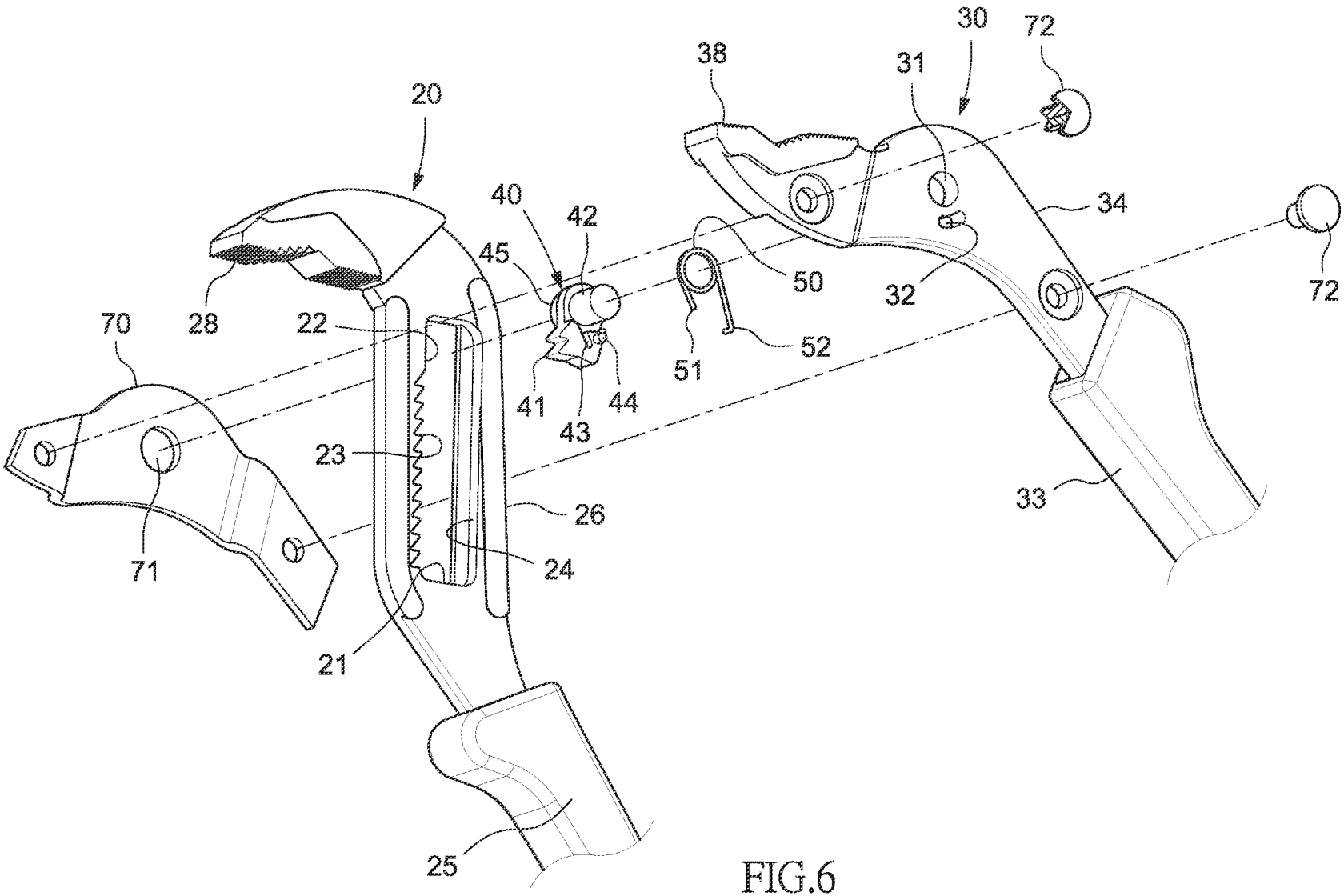
FIG. 6 is a partial and exploded view of the pair of plumbing pliers depicted in FIG. 5.

Referring to FIGS. 5 through 8, a pair of plumbing pliers includes two levers 20 and 30, a torque spring 50, a pawl 40, a positioning plate 70 and two pivots 72 according to the preferred embodiment of the present invention. The levers 20 and 30 are movably connected to each other. The pawl 40 is pivotally connected to the lever 30. The torque spring 50 is arranged between the pawl 40 and the lever 20. The positioning plate 70 is connected to the lever 30 by the pivots 72.

The lever 20 includes a handle 25 formed at an end, a jaw 28 formed at another end, and a shank 26 formed between the handle 25 and the jaw 28. The lever 20 is further formed with a rectilinear slot 21 in the shank 26. The rectilinear slot 21 extends between two edges 22 and 24. There are ratchet teeth 23 formed along an edge of the rectilinear slot 21.

The lever 30 includes a handle 33 formed at an end, a jaw 38 formed at another end and a shank 34 between the handle 33 and the jaw 38. The lever 30 further includes an aperture 31 and an arched slot 32 in the shank 34. The arched slot 32 extends about the aperture 31. The arched slot 32 includes two closed ends.

The pawl 40 is formed with ratchet teeth 41, two shafts 42 and 45, a recess 43 and a boss 44. The ratchet teeth 41 are formed at an edge of the pawl 40. The shaft 42 and the boss 44 are formed on a first side of the pawl 40. The recess 43 is made in the first side of the pawl 40. The shaft 45 is formed on a second side of the pawl 40. The shafts 42 and 45 are coaxial with each other.

The torque spring 50 includes two terminal sections 51 and 52 and a helical portion (not numbered) formed between the terminal sections 51 and 52. The terminal section 51 is a rectilinear section. The terminal section 52 is bent at an end. Preferably, the terminal section 51 extends shorter than the terminal section 52.

The positioning plate 70 includes an orifice 71 corresponding to the aperture 31 of the lever 30.

In assembly, the helical portion of the torque spring 50 is located around the shaft 42 of the pawl 40. The terminal section 51 is inserted in the recess 43.

The pawl 40 is inserted in the rectilinear slot 21 of the lever 20. Thus, the ratchet teeth 41 are engaged with some of the ratchet teeth 23. Moreover, the terminal section 52 of the torque spring 50 is in contact with the edge 24 of the rectilinear slot 21 of the lever 20.

The shank 26 of the lever 20 is located next to the shank 34 of the lever 30. Thus, the shaft 42 of the pawl 40 is inserted in the aperture 31 of the lever 30. Furthermore, the boss 44 is inserted in the arched slot 32. The first closed end of the arched slot 32 is located closer to the terminal section 51 of the torque spring 50 than the second closed end of the arched slot 32 is. The second closed end of the arched slot 32 is located in the vicinity of the terminal section 52 of the torque 50 than the first closed end of the arched slot 32 is.

The positioning plate 70 is located next to the shank 26 of the lever 20. Thus, the shank of the lever 20 is located between the positioning plate 70 and the shank 34 of the lever 30.

The pivots 72 that are preferably rivets are fitted in two apertures (not numbered) of the positioning plate 70 and two additional apertures (not numbered) of the shank 34 of the lever 30 to keep the shank of the lever 20 between the positioning plate 70 and the shank 34 of the lever 30. Thus, the levers 20 and 30 are movably connected to each other.

Figure 7:
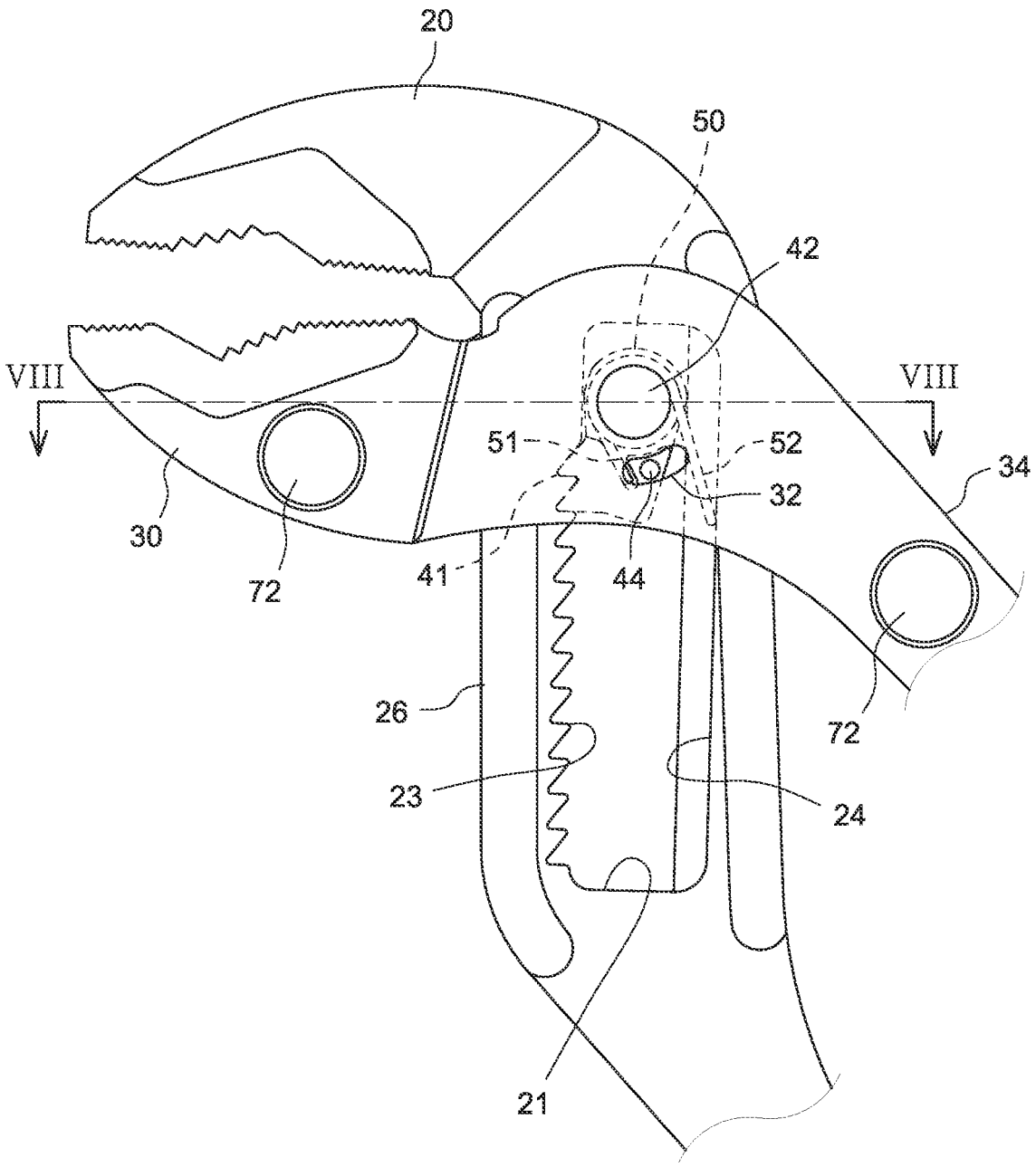
FIG. 7 is an enlarged, partial and side view of the pair of plumbing pliers shown in FIG. 5.
Figure 8:
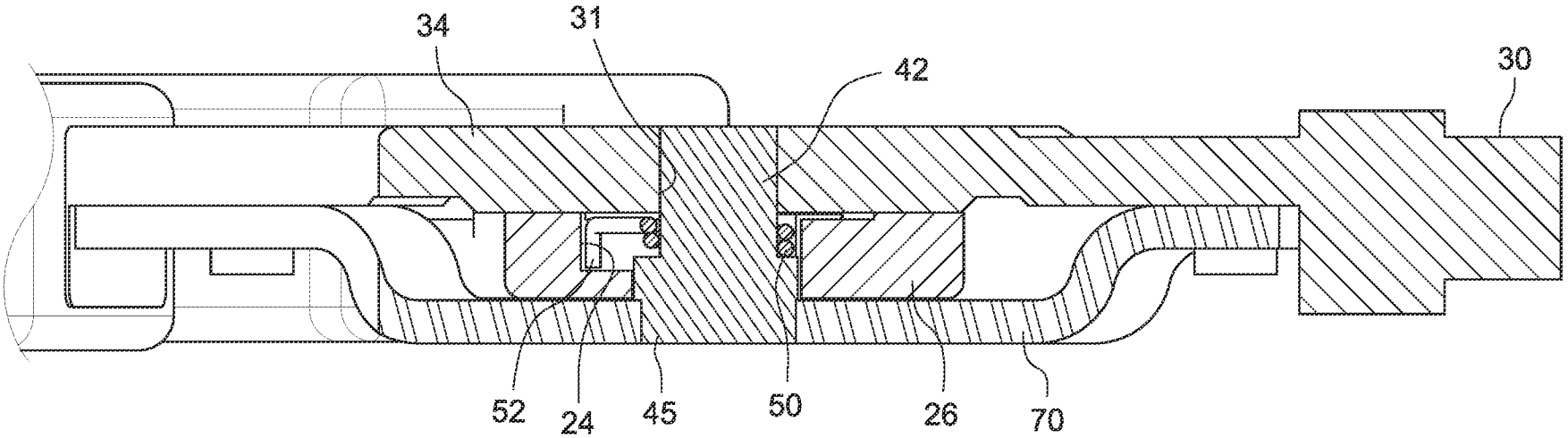
FIG. 8 is a cross-sectional view of the pair of plumbing pliers taken along a line VIII-VIII in FIG. 7.

Referring to FIG. 7, the torque spring 50 tends to engage the ratchet teeth 41 of the pawl 40 with the ratchet teeth 23 of the lever 20. The shape of ratchet teeth 23 and 41 allows the pawl 40 to move upward along the shank 26 of the lever 20. The shank 34 of the lever 30 moves upward along the shank of the lever 20 as the pawl 40 moves upward along shank 26 of the lever 20. Thus, the bite size of the pair of plumbing pliers is reduced.

On the contrary, the shape of ratchet teeth 23 and 41 prevents the pawl 40 from moving downward along the shank 26 of the lever 20. Thus, the bite size of the pair of plumbing pliers cannot be enlarged.

Now, the boss 44 of the pawl 40 is not in contact with any of the closed ends of the arched slot 32 when the ratchet teeth 41 are engaged with some of the ratchet teeth 23. The jaw 30 can be pivoted away from the jaw 20 before one of the closed ends of the arched slot 32 is brought into contact with the boss 44 referring to FIG. 10.

Referring to FIGS. 7 and 9 through 11, an operation to increase a bite size of the pair of plumbing pliers includes two steps. Firstly, a user pivots the handle 33 away from the handle 25 in a first range (or "neutral range"). Referring to FIG. 7, in the first angle, the first closed end of the arched slot 32 is away from the boss 44. Thus, the shank 34 of the lever 30 is pivoted relative to the shank 26 of the lever 20 about the shaft 42 without moving the pawl 40 or compressing the torque spring 50. Thus, the user feels little resistance while pivoting the handle 33.

Figure 9:
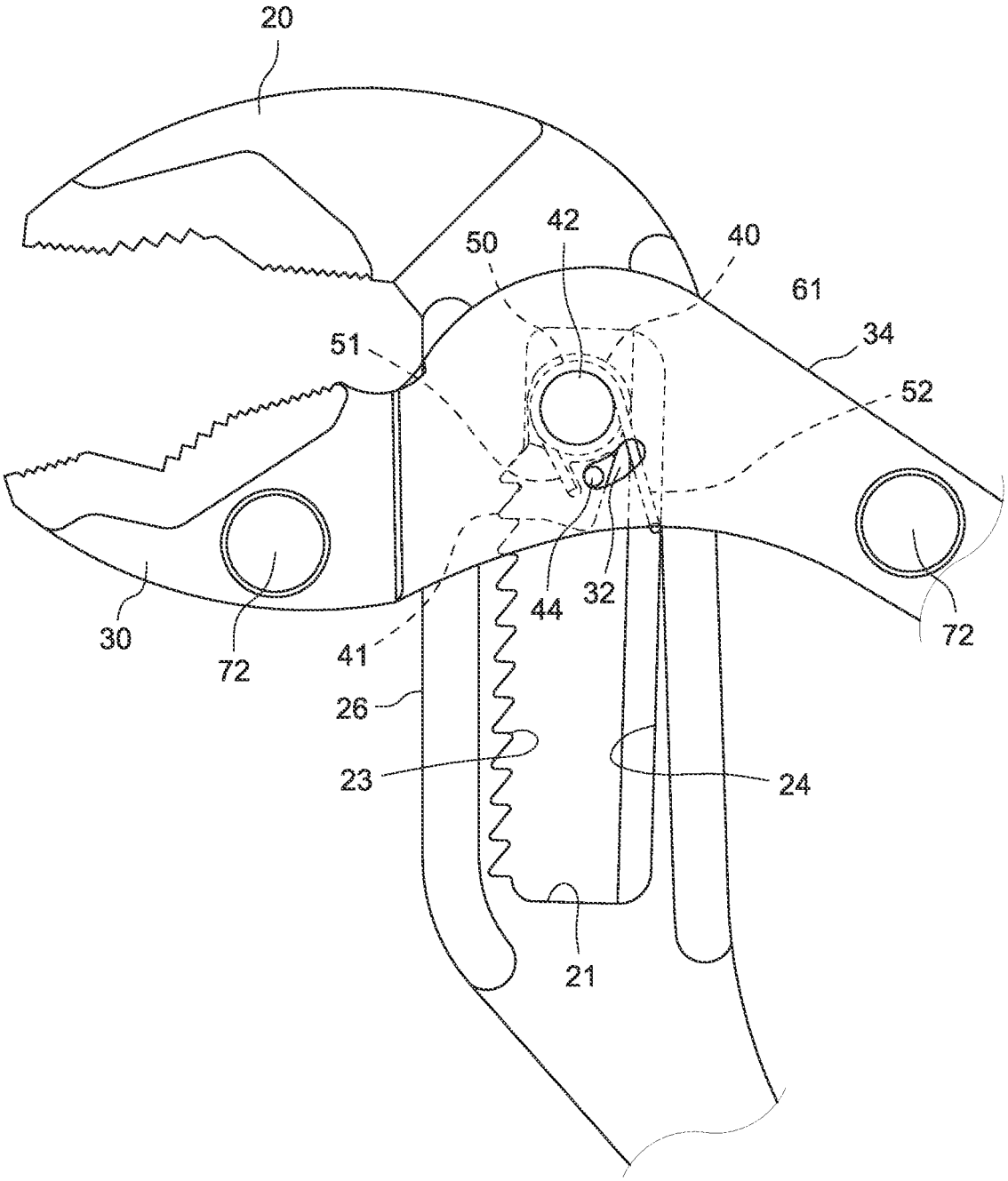
FIG. 9 is a side view of the pair of plumbing pliers in another position than shown in FIG. 7.

Referring to FIG. 9, at an end of the first range, the first closed end of the arched slot 32 is in contact with the boss 44 of the pawl 40. Thus, the user feels a shock from the handle 33.

Figure 10:
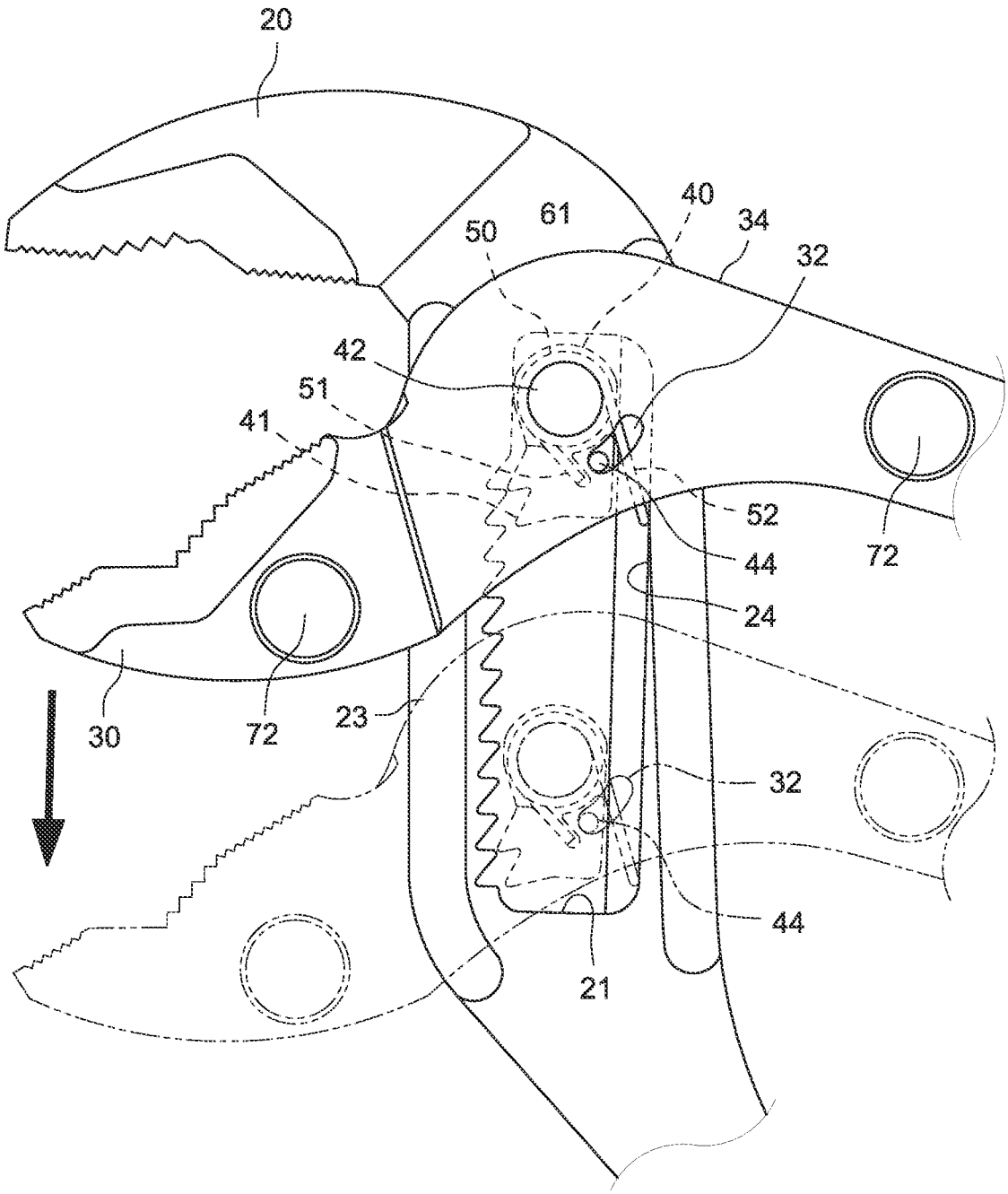
FIG. 10 is a side view of the pair of plumbing pliers in another position than shown in FIG. 9.
Figure 11:
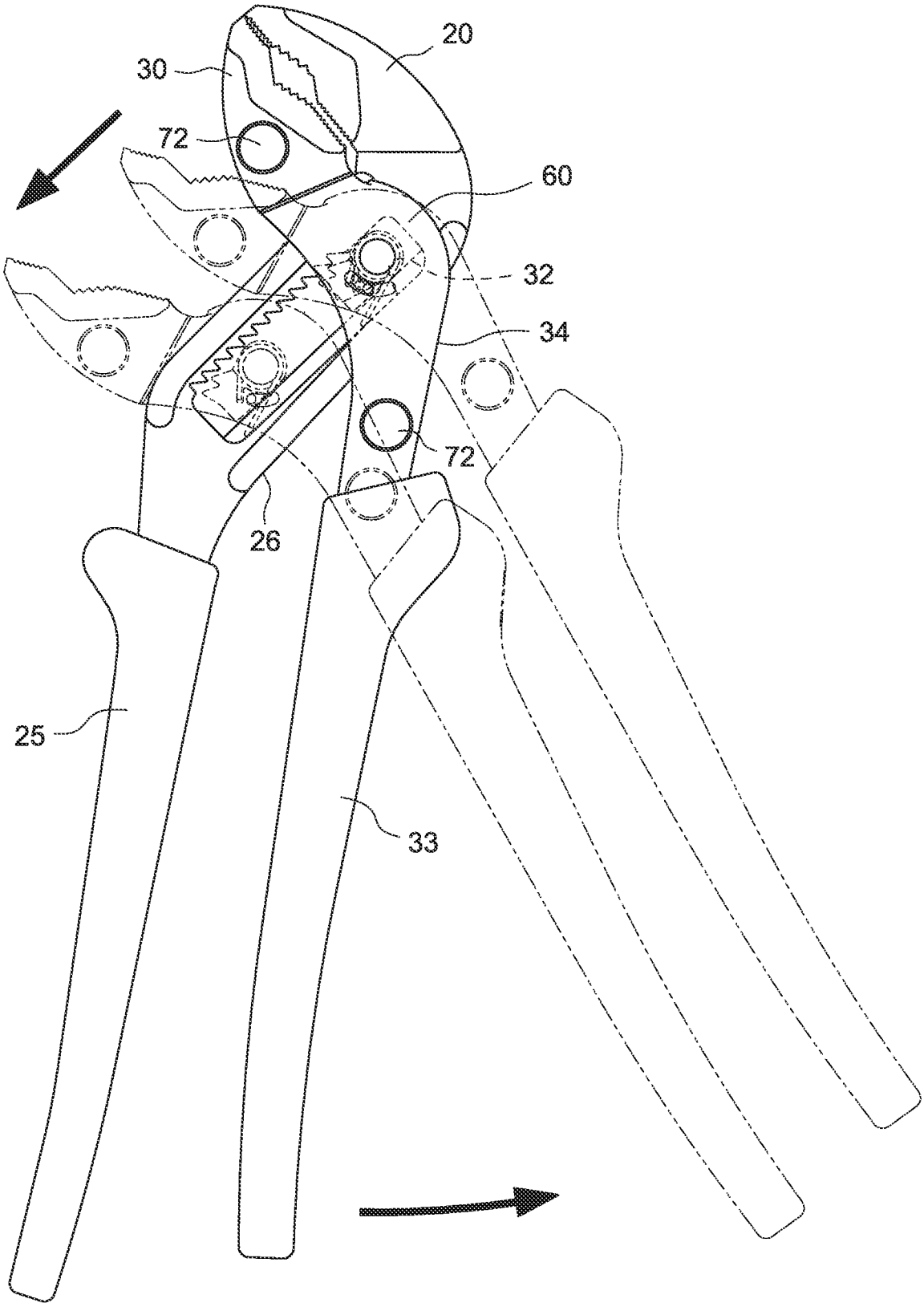
FIG. 11 is a side view of the pair of plumbing pliers in another position than shown in FIG. 10.

Secondly, referring to FIGS. 9 and 10, the user continues to pivot the handle 33 in a second range (or "active range"). In the second range, the first closed end of the arched slot 32 pivots the pawl 40 by the boss 44. Synchronously, the torque spring 50 is compressed so that the user feels considerable resistance and knows that he or she is in the second range and he or she is pivoting the pawls. Accordingly, the ratchet teeth 41 are disengaged from the ratchet teeth 23 to allow the shank 34 of the lever 30 to move downward relative to the shank 26 of the lever 20. That is, the bite size of the pair of plumbing pliers can be increased.

Figure 12:
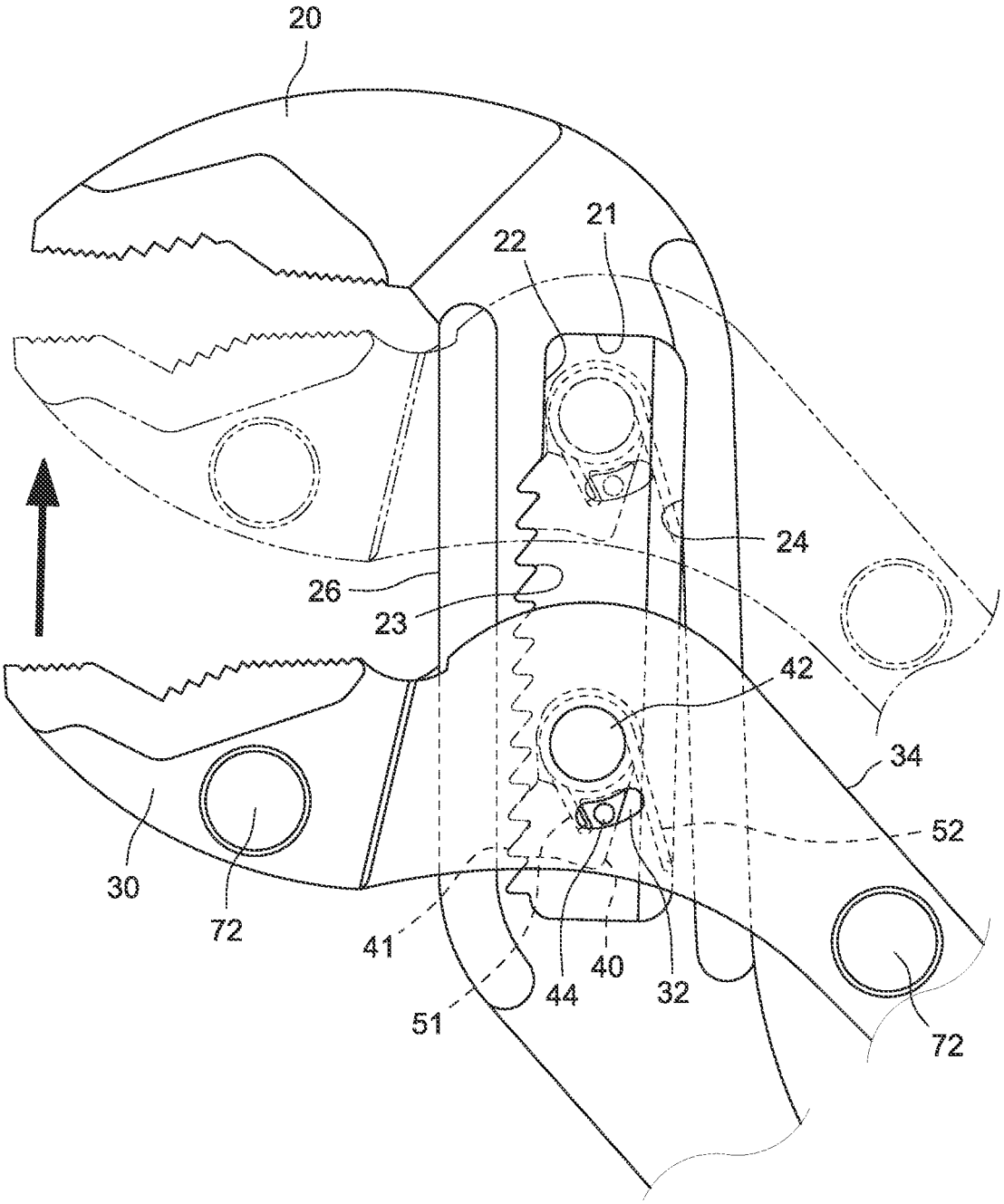
FIG. 12 is a side view of the pair of plumbing pliers in another position than shown in FIG. 11.
Figure 13:
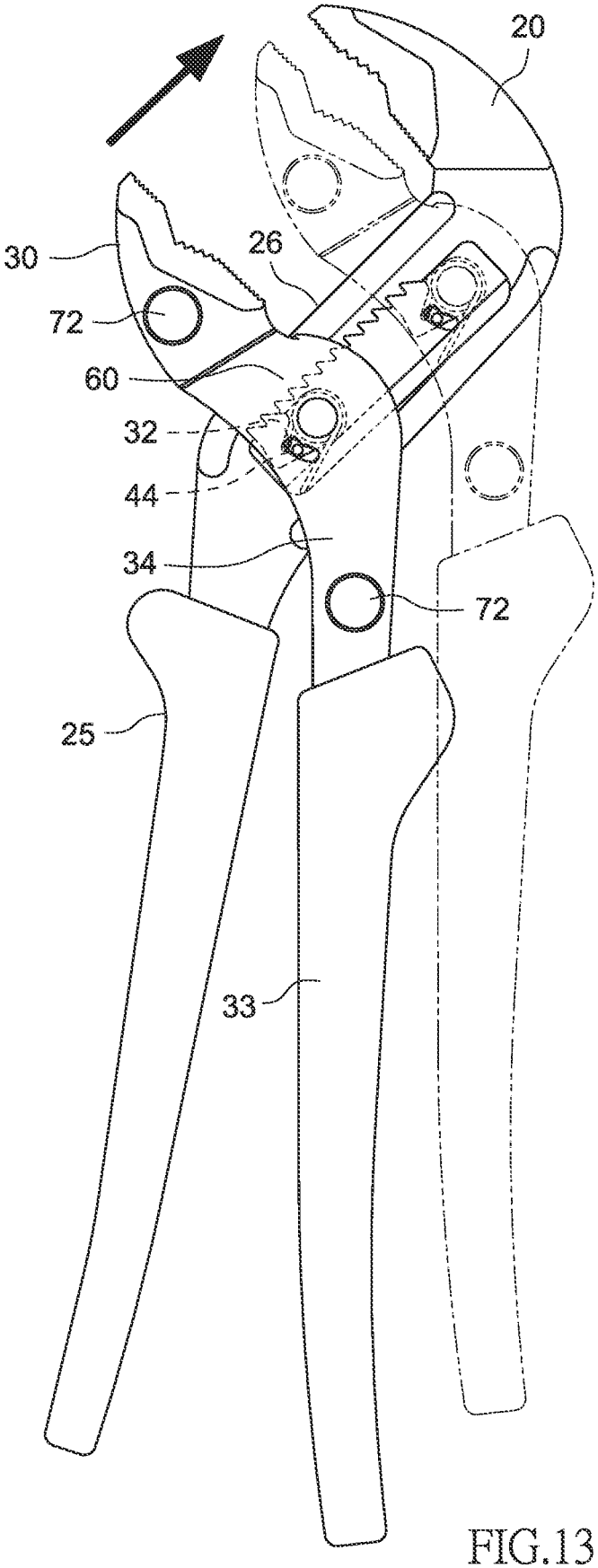
FIG. 13 is a side view of the pair of plumbing pliers in another position than shown in FIG. 12.

Referring to FIGS. 12 and 13, to reduce the bite size of the pair of plumbing pliers, the user pivots the handle 33 toward the handle 25 to disengage the first closed end of the arched slot 32 from the boss 44 of the pawl 40 to allow the torque spring 50 to engage the ratchet teeth 41 with the ratchet teeth 23 again. However, due to the shape of the ratchet teeth 41 and 23, the jaw 38 of the lever 30 can be moved toward the jaw 28 of the lever 20 to reduce the bite size of the pair of plumbing pliers. The ratchet teeth 41 of the pawl 40 rattle on the ratchet teeth 23 of the lever 20 to make noises during the movement of the jaws 28 and 38 toward each other.

After adjusting the desired bite size according to a diameter of a pipe, the user pivots the handle 33 relative to the handle 25 in the first range to clamp and release the pipe repeatedly to rotate the pipe. To adjust the bite size of the pair of plumbing pliers according to a diameter of another pipe, the user pivots the handle 33 relative to the handle 25 in the second range and moves the shank 34 of the lever 30 relative to the shank 26 of the lever 20. As described above, the user feels little resistance in the first range but feels considerable resistance in the second range. Hence, the user can easily detect the difference between the first and second ranges. Accordingly, it is not likely that the user will, by mistake, enter the second range, i.e., increase the bite size of the pair of plumbing pliers.

The present invention has been described via the illustration of the preferred embodiment. Those skilled in the art can derive variations from the preferred embodiment without departing from the scope of the present invention.

Therefore, the preferred embodiment shall not limit the scope of the present invention defined in the claims.

The invention claimed is:

1. A pair of plumbing pliers comprising a first lever (20), a second lever (30) and a pawl (40), wherein the first lever (20) comprises a jaw (28), a handle (25), a shank (26) formed between the jaw (28) and the handle (25), a rectilinear slot (21) in the shank (26), and ratchet teeth (23) formed along an edge of the rectilinear slot (21), wherein the second lever (30) comprises a jaw (38), a handle (33), a shank (34) formed between the jaw (38) of the second lever (30) and the handle (33) of the second lever (30), an aperture (31) in the shank (34) of the second lever (30), and an arched slot (32) in the shank (34) of the second lever (30), wherein the arched slot (32) comprises a first closed end and a second closed end, wherein the shanks (26, 34) of the first and second levers (20, 30) are pivotally connected to each other, wherein the pawl (40) is inserted in the rectilinear slot (21) and comprises a shaft (42) inserted in the aperture (31) of the shank (34) of the second lever (30) to pivotally connect the pawl (40) to the shank (34) of the second lever (30) and ratchet teeth (41) for engagement with the ratchet teeth (23) of the first lever (20), characterized in that:

the pawl (40) comprises a recess (43) and a boss (44) movably inserted in the arched slot (32);

a torque spring (50) comprises a first terminal section (51) inserted in the recess (43) of the pawl (40), a second terminal section (52) abutted against another edge of the rectilinear slot (21) of the first lever (20) so that the torque spring (50) brings the ratchet teeth (41) of the pawl (40) into engagement with the ratchet teeth (23) of the first lever (20), and a helical section formed between the terminal sections (51, 52) and extending around the shaft (42) to keep the torque spring (50) in position, wherein the first and second terminal sections (51, 52) of the torque spring (50) are not in contact with the first and second closed ends of the arched slot (32) of the second lever (30);

in a first range of pivoting the handle (33) of the second lever (30) relative to the handle (25) of the first lever (20), the first closed end of the arched slot (32) is not in contact with the boss (44), thereby allowing the torque spring (50) to keep the ratchet teeth (41) of the pawl (40) engaged with the ratchet teeth (23) of the first lever (20) to prevent movement of the shank (34) of the second lever (30) relative to the shank (26) of the first lever (20); and in a second range of pivoting the handle (33) of the second lever (30) relative to the handle (25) of the first lever (20), the first closed end of the arched slot (32) is in contact with the boss (44) to disengage the ratchet teeth (41) of the pawl (40) from the ratchet teeth (23) of the first lever (20) to allow movement of the shank (34) of the second lever (30) relative to the shank (26) of the first lever (20).

* * * * *